US007423601B2

(12) United States Patent
Brown et al.

(10) Patent No.: US 7,423,601 B2
(45) Date of Patent: Sep. 9, 2008

(54) REFLECT ARRAY ANTENNAS HAVING MONOLITHIC SUB-ARRAYS WITH IMPROVED DC BIAS CURRENT PATHS

(75) Inventors: Kenneth W. Brown, Yucaipa, CA (US); George G. Jones, Riverside, CA (US); Andrew K. Brown, Victorville, CA (US); William E. Dolash, Montclair, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/254,460

(22) Filed: Oct. 20, 2005

(65) Prior Publication Data

US 2007/0090997 A1 Apr. 26, 2007

(51) Int. Cl.
*H01Q 19/06* (2006.01)

(52) U.S. Cl. ..... 343/754; 343/700 MS; 343/853; 343/912

(58) Field of Classification Search ..... 343/700 MS, 343/754, 912, 853, 753, 755
See application file for complete search history.

(56) References Cited

U.S. PATENT DOCUMENTS

| | | | | |
|---|---|---|---|---|
| 6,081,235 | A * | 6/2000 | Romanofsky et al. | 343/700 MS |
| 6,441,787 | B1 * | 8/2002 | Richards et al. | 343/700 MS |
| 6,653,985 | B2 * | 11/2003 | Sikina et al. | 343/853 |
| 6,765,535 | B1 | 7/2004 | Brown et al. | |
| 7,030,824 | B1 * | 4/2006 | Taft et al. | 343/767 |
| 7,161,539 | B2 * | 1/2007 | Chang et al. | 343/700 MS |

* cited by examiner

*Primary Examiner*—Hoang V Nguyen
(74) *Attorney, Agent, or Firm*—Schwegman, Lundberg & Woessner, P.A.; Gregory J. Gorrie

(57) ABSTRACT

Embodiments of active array antennas are generally described herein. Other embodiments may be described and claimed. In some embodiments, a reflect array antenna includes an array of rectangular monolithic sub-array modules arranged in a non-uniform pattern to leave a plurality of rectangular gaps in the pattern. A DC feed pin located within each gap may provide DC bias current to the sub-array modules. The sub-array modules may be mounted on a heat sink in the non-uniform pattern. The heat sink may have holes aligned with the gaps to allow passage of the DC feed pins. In some embodiments, an array cooling assembly may be coupled to the back of the heat sink to cool the reflect array antenna with a coolant.

49 Claims, 11 Drawing Sheets

SUB ARRAY ELEMENT

ARRAY COOLING ASSEMBLY

THERMAL VIAS

REFLECT ARRAY ANTENNAS HAVING MONOLITHIC SUB-ARRAYS WITH IMPROVED DC BIAS CURRENT PATHS

TECHNICAL FIELD

Embodiments of the present invention pertain to active reflective array antennas.

BACKGROUND

Active reflect array antennas that are fabricated with one or more monolithic substrates require substantial DC current for high-power applications. As these substrates are tiled closely together to form a larger array, the routing of the DC bias lines to each chip becomes increasingly difficult due to the substantial DC current requirements of a large array. This is especially a problem when lower-voltage devices requiring higher current are used for amplification. Thus, there are general needs for improved techniques for providing DC current in reflect-array antennas.

SUMMARY OF THE INVENTION

In some embodiments, a reflect array antenna includes an array of rectangular monolithic sub-array modules arranged in a non-uniform pattern to leave a plurality of rectangular gaps in the pattern. A DC feed pin located within each gap may provide DC bias current to the sub-array modules. The sub-array modules may be mounted on a heat sink in the non-uniform pattern. The heat sink may have holes aligned with the gaps to allow passage of the DC feed pins. In some embodiments, an array cooling assembly coupled to the back of the heat sink to cool the reflect array antenna with a coolant.

In some alternative embodiments, a reflect array antenna includes an array of groups of monolithic sub-array modules. Each group is adhered to a circuit board. Each circuit board includes DC bias current bonding pads along at least one or more of its edges. The outer sub-array modules of a group may receive DC bias current directly from the bonding pads. In some embodiments, bond wires may couple the bonding pads to bias grids of the monolithic sub-array modules along a perimeter of the circuit board.

In yet some other alternative embodiments, a reflect array antenna includes a plurality of active sub-array elements arranged in a uniform pattern on a circuit board. Each circuit board includes a plurality of DC bias feeds through the circuit board to couple with bias pads of the sub-array elements. A plurality of the circuit boards is arranged in a uniform pattern on a heat sink. The circuit boards may include thermal vias to thermally couple the sub-array elements with the heat sink.

In some embodiments, a millimeter wave deterring device is provided. The device includes an active reflect array antenna and a W-band RF source. The W-band RF source may generate a substantially spherical wavefront for incident on the active reflect array antenna. The active reflect array antenna may amplify the incident wavefront and generate a high-power wavefront. The high-power wavefront may produce a deterring effect on a human target.

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to limit the scope of this application to any single invention or inventive concept if more than one is in fact disclosed.

In active reflect array antennas, producing high power at millimeter wave frequencies, and in particular at W-band, may require the use of relatively low-voltage transistors (e.g., in the 2-3 volt range). This invariably requires high-current to be fed to each monolithic sub-array chip. The sub-array chips may include a DC power grid, however when these chips are tiled together to form a large array with their DC inputs connected, the chips on the outer portion of the array are required to handle an increased amount of current. This significantly limits the maximum size of the array. In accordance with some embodiments of the present invention, active reflect array antennas are provided that allow increased bias current to be provided to sub-array chips permitting the fabrication of significantly larger and more powerful arrays.

Figure 1B:
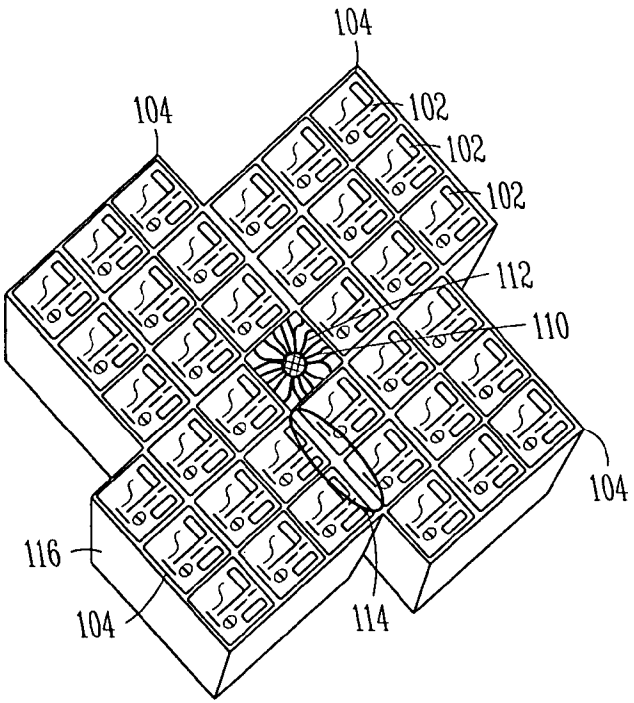
FIG. 1B illustrates a portion of the reflect array antenna of FIG. 1A in accordance with some embodiments of the present invention.
Figure 1A:
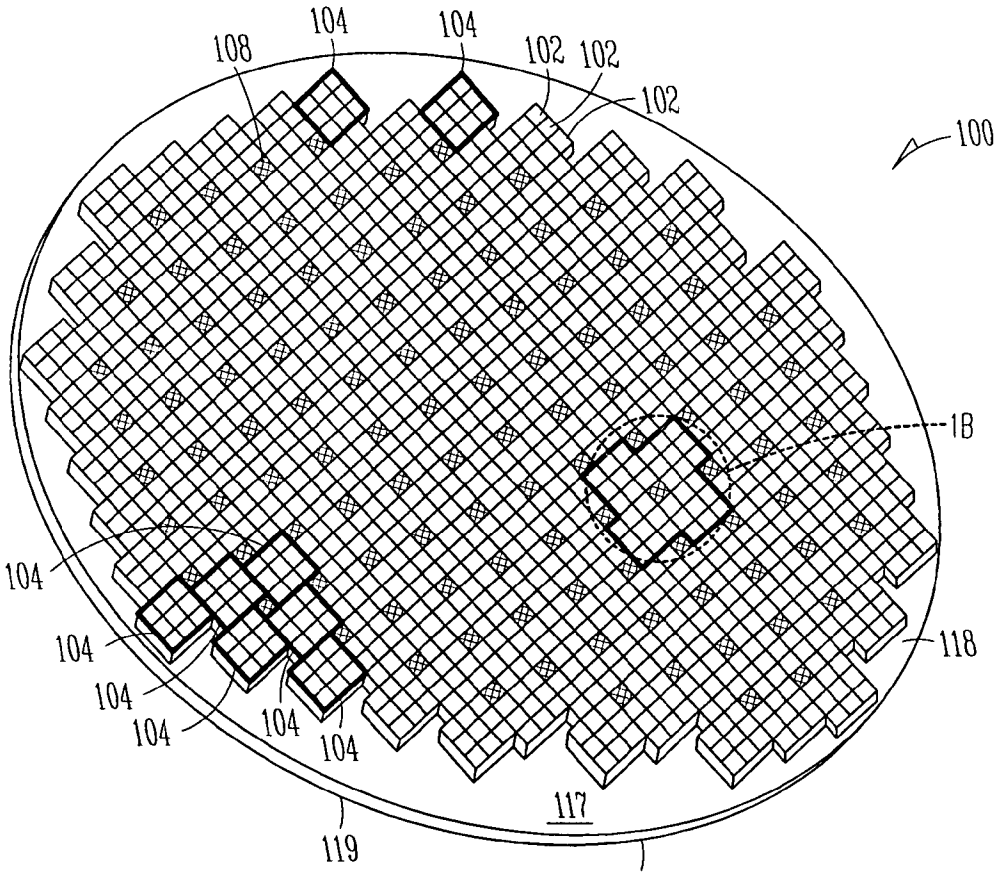
FIG. 1A illustrates a perspective view of a reflect array antenna in accordance with some embodiments of the present invention.
Figure 1C:
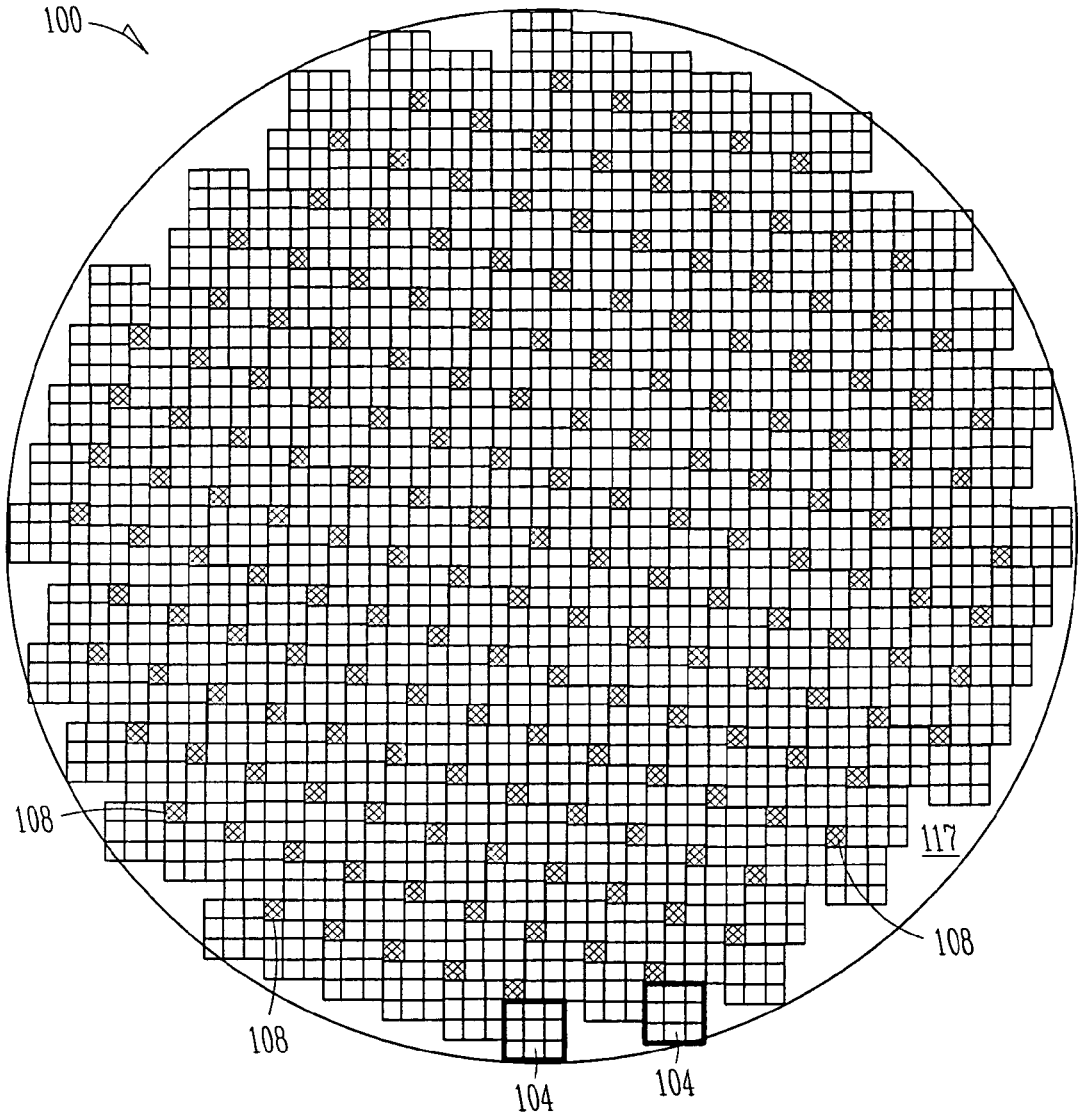
FIG. 1C illustrates a top view of the reflect array antenna of FIG. 1A in accordance with some embodiments of the present invention.

FIG. 1A illustrates a perspective view of a reflect array antenna in accordance with some embodiments of the present invention. FIG. 1B illustrates a portion of the reflect array antenna of FIG. 1A in accordance with some embodiments of the present invention. FIG. 1C illustrates a top view of the reflect array antenna of FIG. 1A in accordance with some embodiments of the present invention. Reflect array antenna 100 includes an array of rectangular monolithic sub-array modules 104 arranged in non-uniform pattern 118. A non-uniform pattern may leave a plurality of rectangular gaps 108 in the pattern. In some embodiments, the gaps are smaller in size than a size of sub-array modules 104. In FIGS. 1A and 1B, sub-array modules 104 are illustrated as 3×3 squares, and gaps 108 are illustrated as 1×1 squares. Reflect array antenna 100 also includes DC feed pin 110 located within each gap 108 to provide DC bias current to sub-array modules 104. The use of DC feed pins 110 within gaps 108 allow significantly more DC bias current to be provided to sub-array modules 104. In some embodiments, each sub-array module 104 may be a monolithic sub-array (e.g., may be on a single semiconductor substrate), although the scope of the invention is not limited in this respect.

In some embodiments, reflect array antenna 100 may further comprise heat sink 116. Sub-array modules 104 may be mounted on heat sink 116 in non-uniform pattern 118. Heat sink 116 may have holes aligned with gaps 108 to allow passage of DC feed pins 110. In some embodiments, heat sink 116 may be substantially round when viewed from the top or bottom as illustrated, although the scope of the invention is not limited in this respect. In some embodiments, heat sink 116 may have a curved or substantially paraboloidal surface 117 and sub-array modules 104 may be mounted on surface 117 in non-uniform pattern 118. The curved or substantially paraboloidal surface 117 may allow reflect array antenna 100 to transmit a converging or collimated wavefront depending on the received wavefront.

In some embodiments, each sub-array module 104 may have a number of sub-array elements 102. Sub-array modules 104 may also include a bias grid separating sub-array elements 102. The bias grid may receive the DC bias current from DC feed pins 110.

In some embodiments, reflect array antenna 100 may include a plurality of DC feed lines 112 coupling each of DC feed pins 110 to the bias grids of sub-array elements 102 adjacent to gaps 108. In some embodiments, sub-array elements 102 may include an amplifier element that receives some of the DC bias current that is supplied at a drain bias voltage between two and three volts. In some embodiments, wire bonds 114 may couple the bias grids of adjacent sub-array modules 104. In some embodiments, DC feed pin 110 within each gap 108 may provide drain current to amplifier elements of the sub-array modules 104. In some embodiments, gap 108 may include a second feed pin to provide gate bias to amplifier elements of the sub-array modules 104.

Figure 2A:
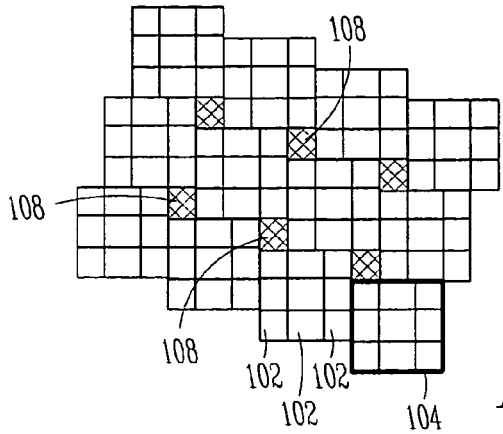
FIGS. 2A, 2B and 2C illustrate alternative non-uniform patterns of sub-array modules in accordance with some embodiments of the present invention.
Figure 2B:
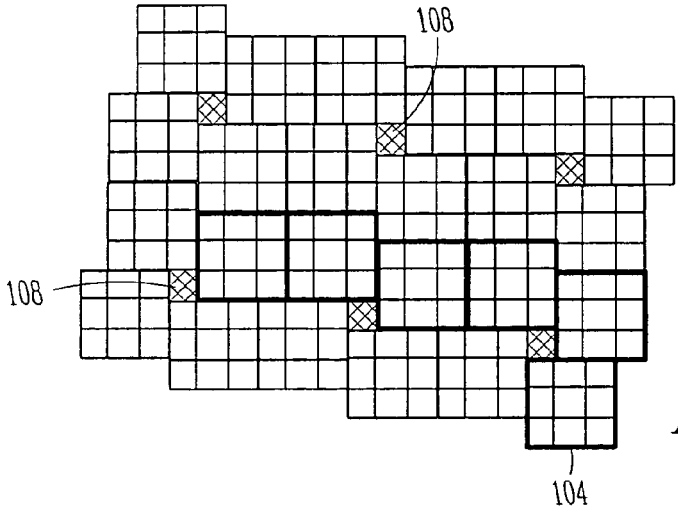
Figure 2C:
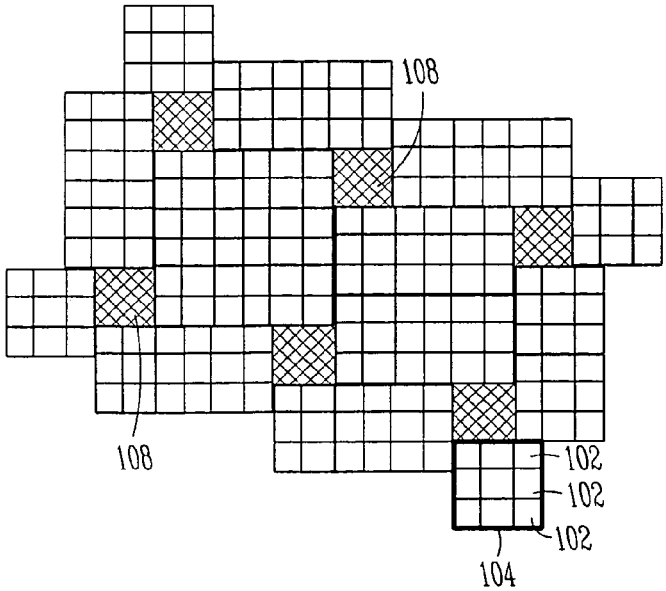

FIGS. 2A, 2B and 2C illustrate alternative non-uniform patterns of sub-array modules in accordance with some embodiments of the present invention. These alternate non-uniform patterns are described in more detail below.

Figure 3:
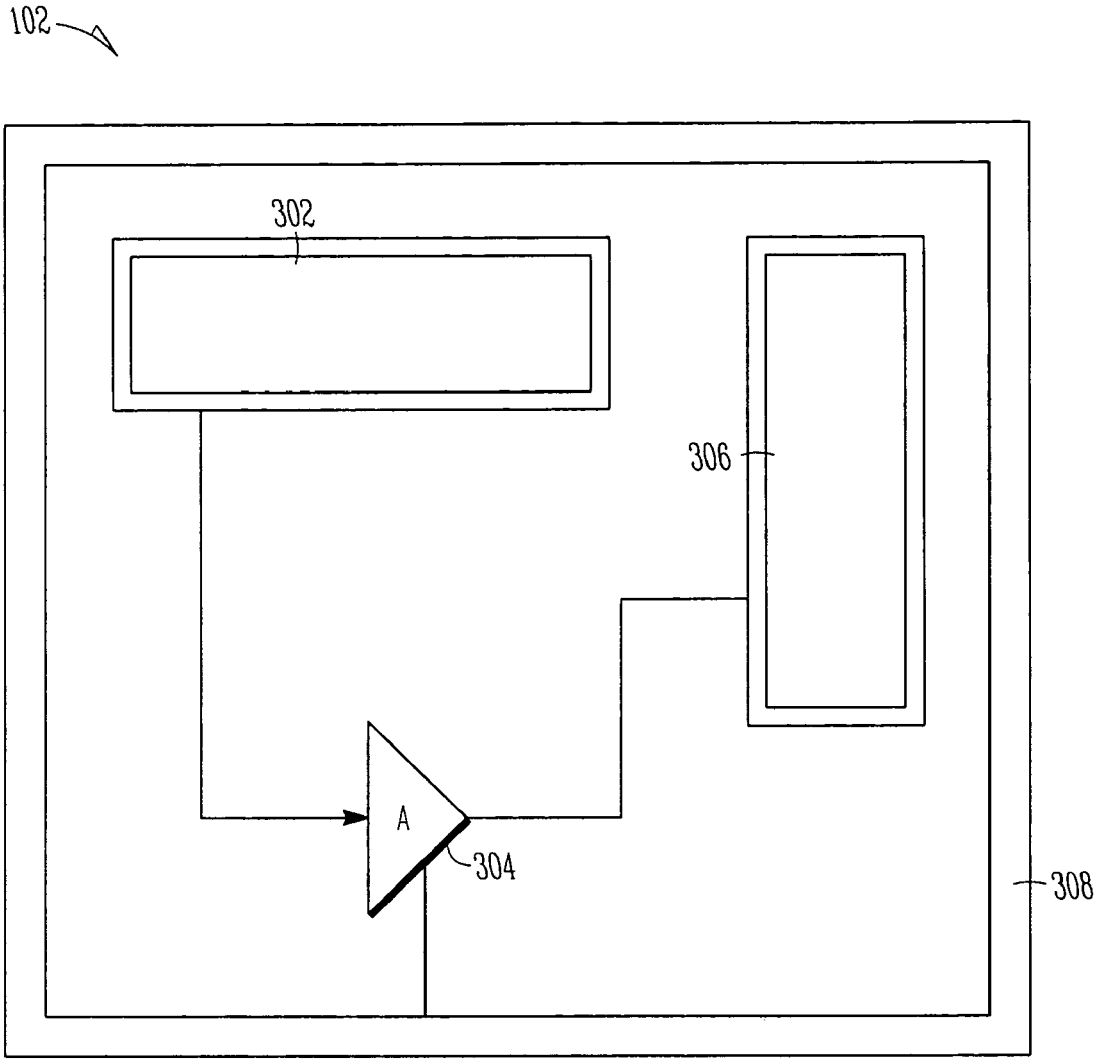
FIG. 3 illustrates a functional block diagram of a sub-array element in accordance with some embodiments of the present invention.

FIG. 3 illustrates a functional block diagram of a sub-array element in accordance with some embodiments of the present invention. Sub-array element 102 may include receive antenna 302, amplifier element 304 and transmit antenna 306. In some embodiments, receive antenna 302 may receive a spatially-fed radio-frequency (RF) input signal, amplifier element 304 may amplify the received RF input signal, and transmit antenna 306 may transmit an amplified version of the RF input signal. In some embodiments, the RF input signal may be a millimeter wave or a W-band signal, and the receive antenna and transmit antennas may have orthogonal polarizations. In some embodiments, the receive antennas may have a horizontal polarization so that horizontally polarized signals are received, and the transmit antennas may have a vertical polarization so that vertically polarized signals are transmitted. The use of the terms horizontal and vertical are not meant to be limiting and can be interchanged.

In some embodiments, each sub-array module 104 (FIGS. 1A & 1B) comprises a single monolithic substrate and a plurality of sub-array elements 102. Each sub-array module 104 may be fabricated on the single monolithic substrate. In some embodiments, receive antennas 302 and transmit antennas 306 are cavity-backed antennas. In these embodiments, the single integrated substrate may include cavities adjacent to the receive and transmit antennas (e.g., the cavities may be below the antennas and aligned with the antennas). In some embodiments, heat sink 116 may include cavities adjacent to the receive and transmit antennas, although the scope of the invention is not limited in this respect. Bias grid 308 may provide DC bias current to sub-array elements 102 of sub-array module 104.

Figure 4:
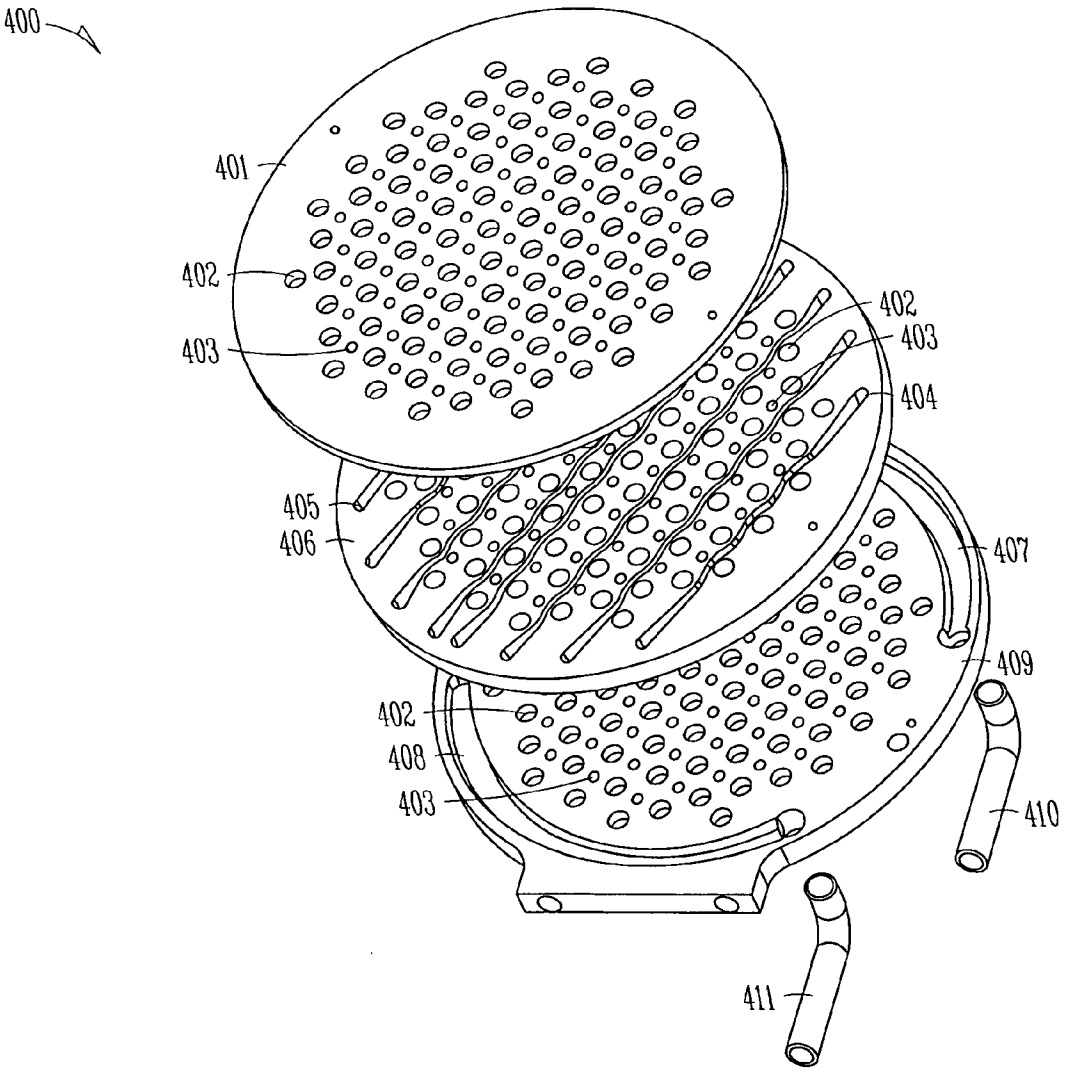
FIG. 4 illustrates an array cooling assembly in accordance with some embodiments of the present invention.

FIG. 4 illustrates an array cooling assembly in accordance with some embodiments of the present invention. In some embodiments, reflect array antenna 100 may utilize an array cooling assembly, such as array cooling assembly 400, which may be coupled to heat sink 116 (FIG. 1A), to cool the reflect array antenna 100. In these embodiments, array cooling assembly 400 may have holes 402 aligned with gaps 108 to allow passage of the DC feed pins 110 (FIG. 1B). In some embodiments, array cooling assembly 400 may be cooled by a coolant that flows through array cooling assembly 400. In some embodiments, the coolant may be a phase-change fluid, such as a refrigerant. In some other embodiments, the coolant may be water or other liquid. In other embodiments, the coolant may be a gas, although the scope of the invention is not limited in this respect.

In some embodiments, array cooling assembly 400 may be curved or paraboloidal to couple with heat sink 116 (FIG. 1A) when heat sink 116 (FIG. 1A) is curved or paraboloidal, although the scope of the invention is not limited in this respect. In some other embodiments, bottom surface 119 (FIG. 1A) of heat sink 116 (FIG. 1A) may be flat.

Array cooling assembly 400 may include cover cap 401, clearance holes 403 for clamp screws, cooler plate 406, base 409, coolant supply tube 410 and coolant return tube 411. Coolant may flow from supply tube 410 to input supply manifold 407, through coolant path 404-405, returning to output supply manifold 408 to return tube 411.

Figure 5:
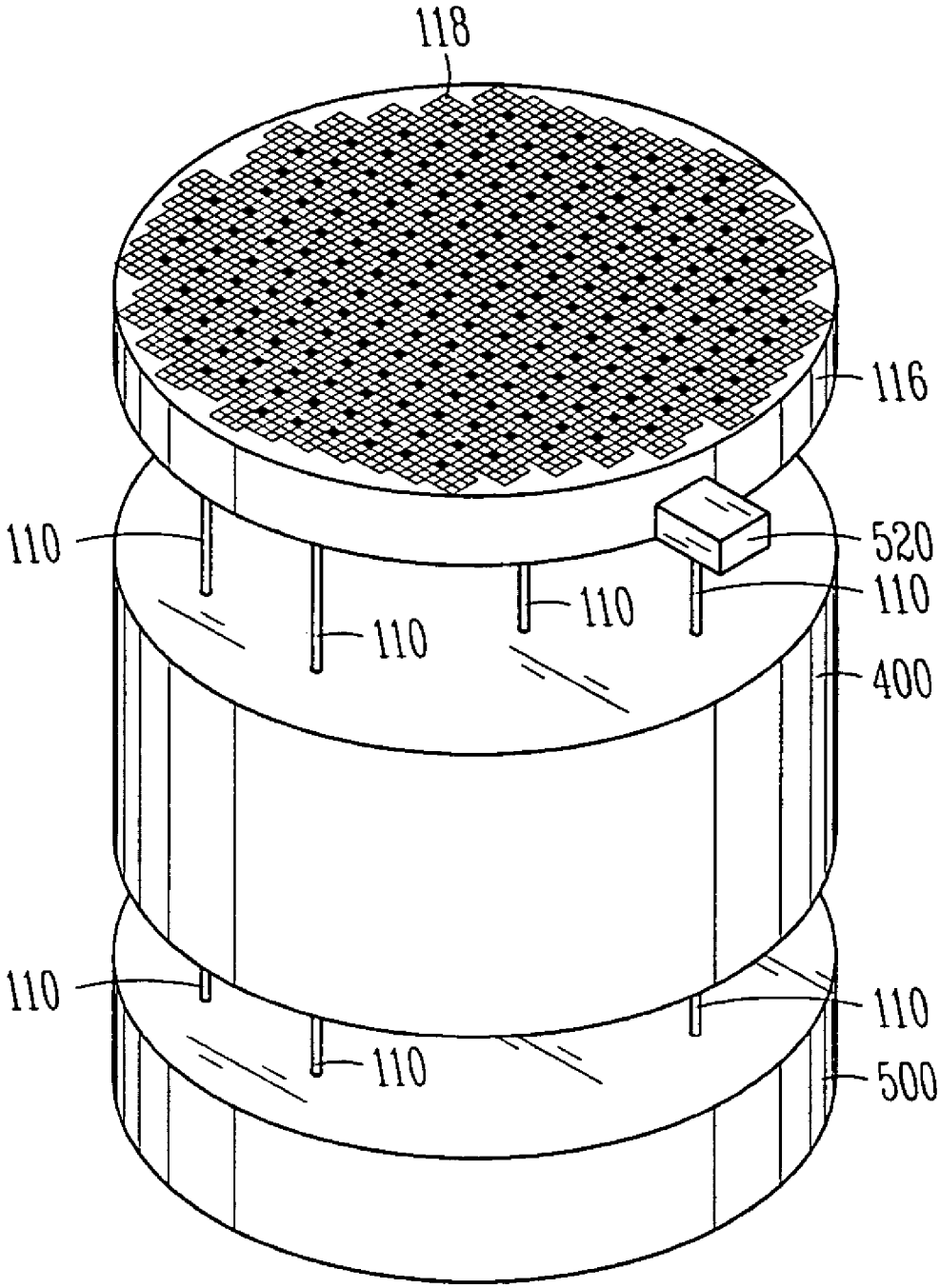
FIG. 5 illustrates various layers of a reflect array antenna in accordance with some embodiments of the present invention.

FIG. 5 illustrates the various layers of a reflect array antenna in accordance with some embodiments of the present invention. The reflect array antenna of these embodiments may include bias current layer 500, cooling assembly 400 and upper layer which includes heat sink 116 (FIG. 1A) and sub-array modules 104 (FIG. 1A). Bias current layer 500 may provide the DC bias current to sub-array modules 104 (FIG. 1A). In these embodiments, array cooling assembly 400 may be located between heat sink 116 and the bias current layer 500. In some embodiments, the reflect array antenna of these embodiments may include temperature sensor 520 to monitor the temperature of the reflect array antenna. In these embodiments, the pressure and flow-rate of the coolant may be controlled based on the monitored temperature. In some embodiments, temperature sensor 520 may be a sensor switch.

Referring back to FIGS. 1A 1B and 1C, in some embodiments, sub-array modules 104 may be either substantially square or rectangular and gaps 108 may be either substantially square or rectangular. In some embodiments, sub-array modules 104 may have exactly a perfect square number of active array elements 102. In some of these embodiments, the area of each of gaps 108 in pattern 118 may be substantially a square area equal to approximately a perfect square number of active array elements that is lower than a perfect square number of active array elements 102 of each sub-array module 104. In some embodiments, each sub-array module 104 may include 4, 9, 16, 25, 36, 49, etc. active array elements 102. The numbers 1, 4, 9, 16, 25, 36, 49, etc. are the perfect squares. In these embodiments, the area of each of gaps 108 may be equal to approximately the area of a perfect square number lower than the perfect square number of active-array elements 102 of sub-array module 104. For example, when there are nine 9 active array elements 102 in each sub-array module 104, each gap in the pattern may have a square area approximately equal to either four 4 sub-array elements 102 (as illustrated in FIG. 2C), or a square area equal to one 1 sub-array element 102 (as illustrated in FIGS. 1A, 2A and 2B). In some embodiments, when there are sixteen 16 active array elements 102 in each sub-array module 104, each gap 108 in the pattern may have a square area approximately equal to nine 9 sub-array elements 102, four 4 sub-array elements 102, or one 1 sub-array element 102. In some embodiments, the perfect square number of active array elements 102 of each sub-array module 104 may comprise 4, 9, 16, 25, 36, 49, etc. although greater numbers are also suitable.

In some embodiments, each sub-array module 104 comprises nine active array elements 102, and the area of gap 108 is approximately equal to an area of either one or four of the active array elements. As illustrated in FIGS. 1A, 1B, 1C, 2A and 2B, the area of gap 108 is equal to about one active array element 102. As illustrated in FIG. 2C, gap 108 is equal to about four active array elements 102. In some embodiments, the pattern includes one gap 108 for approximately every twelve sub-array modules 108 (e.g., as illustrated in FIG. 2A). In some embodiments, the pattern includes one gap 108 for approximately every twenty-four sub-array modules 108 (as illustrated in FIGS. 2B and 2C).

In some other embodiments, gap 108 may be rectangular and not square and/or sub-array modules 104 may be rectangular and not square, although the scope of the invention is not limited in this respect.

Figure 6B:
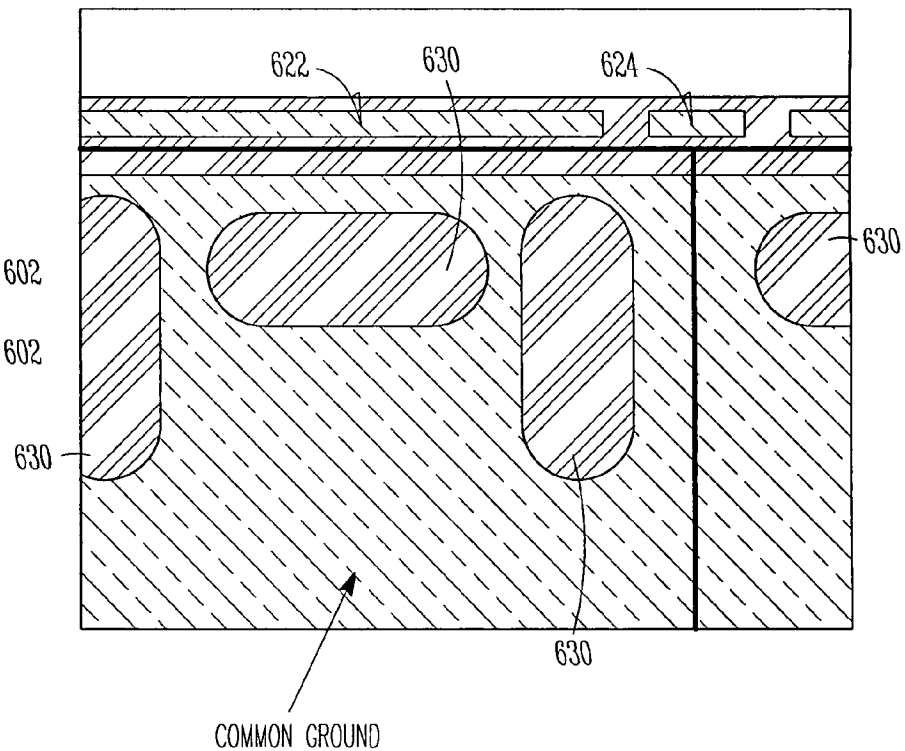
FIGS. 6A and 6B illustrate a circuit board backing for reflect array antennas in accordance with some alternate embodiments of the present invention.
Figure 6A:
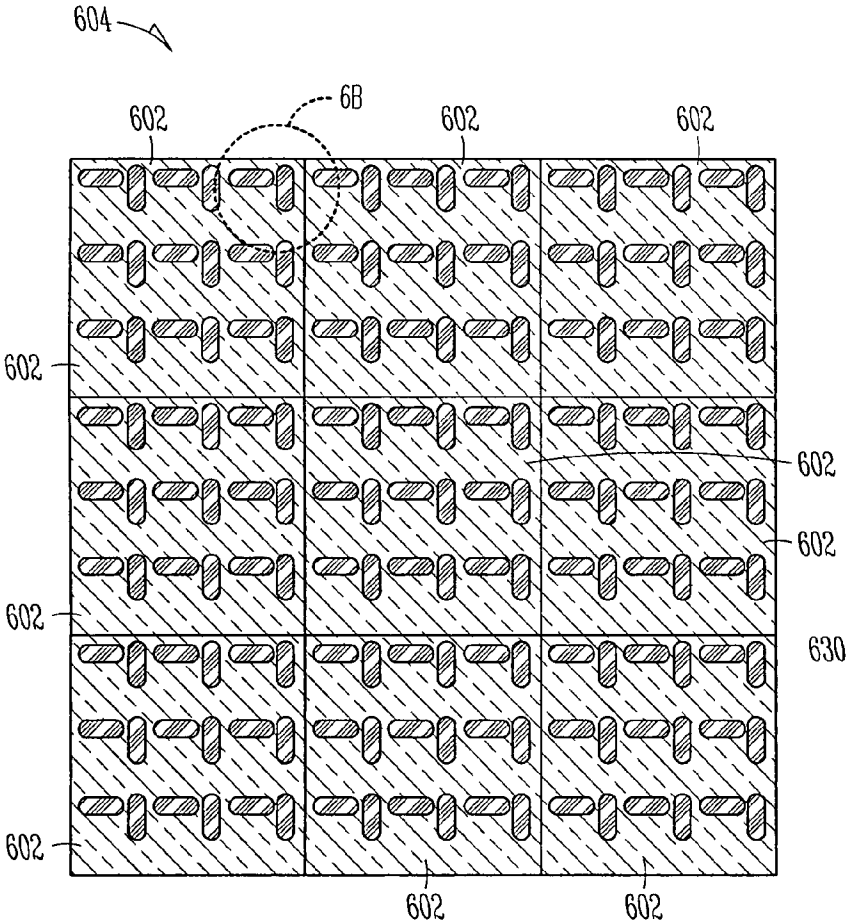
Figure 6D:
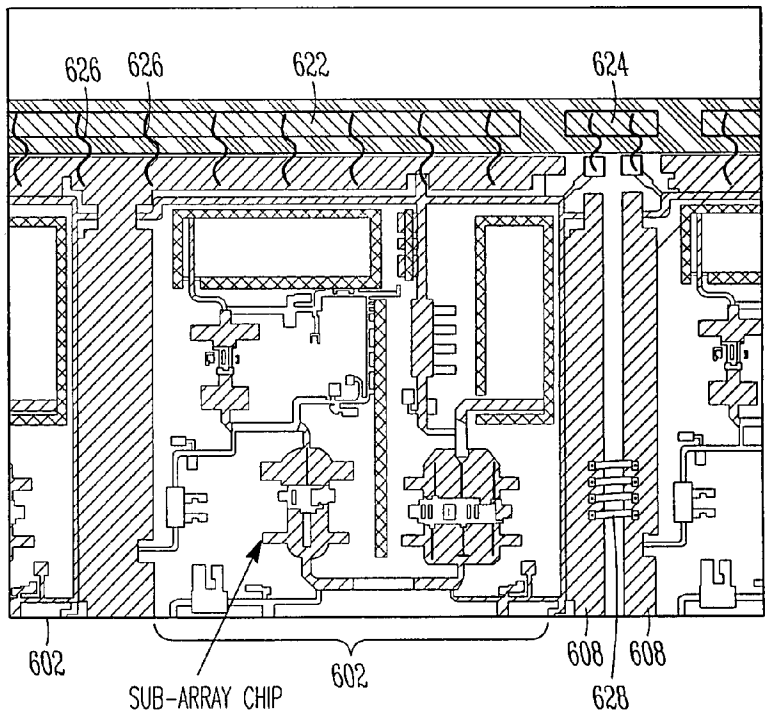
FIGS. 6C and 6D illustrate a group of sub-array modules on the circuit board of FIGS. 6A and 6B in accordance with some embodiments of the present invention.
Figure 6C:
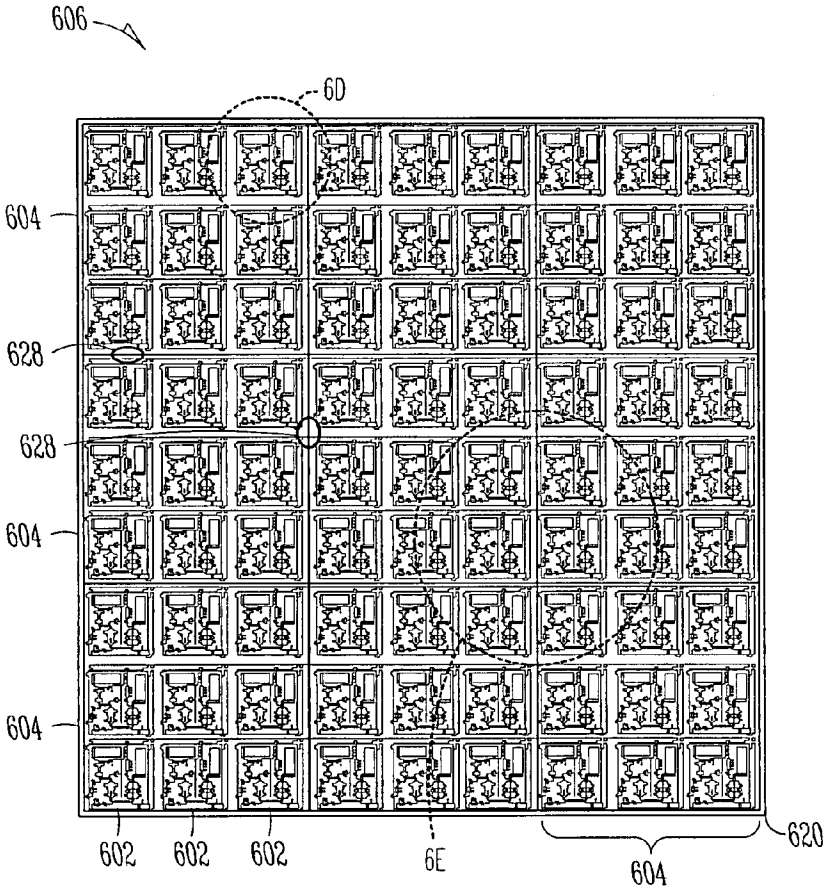
Figure 6E:
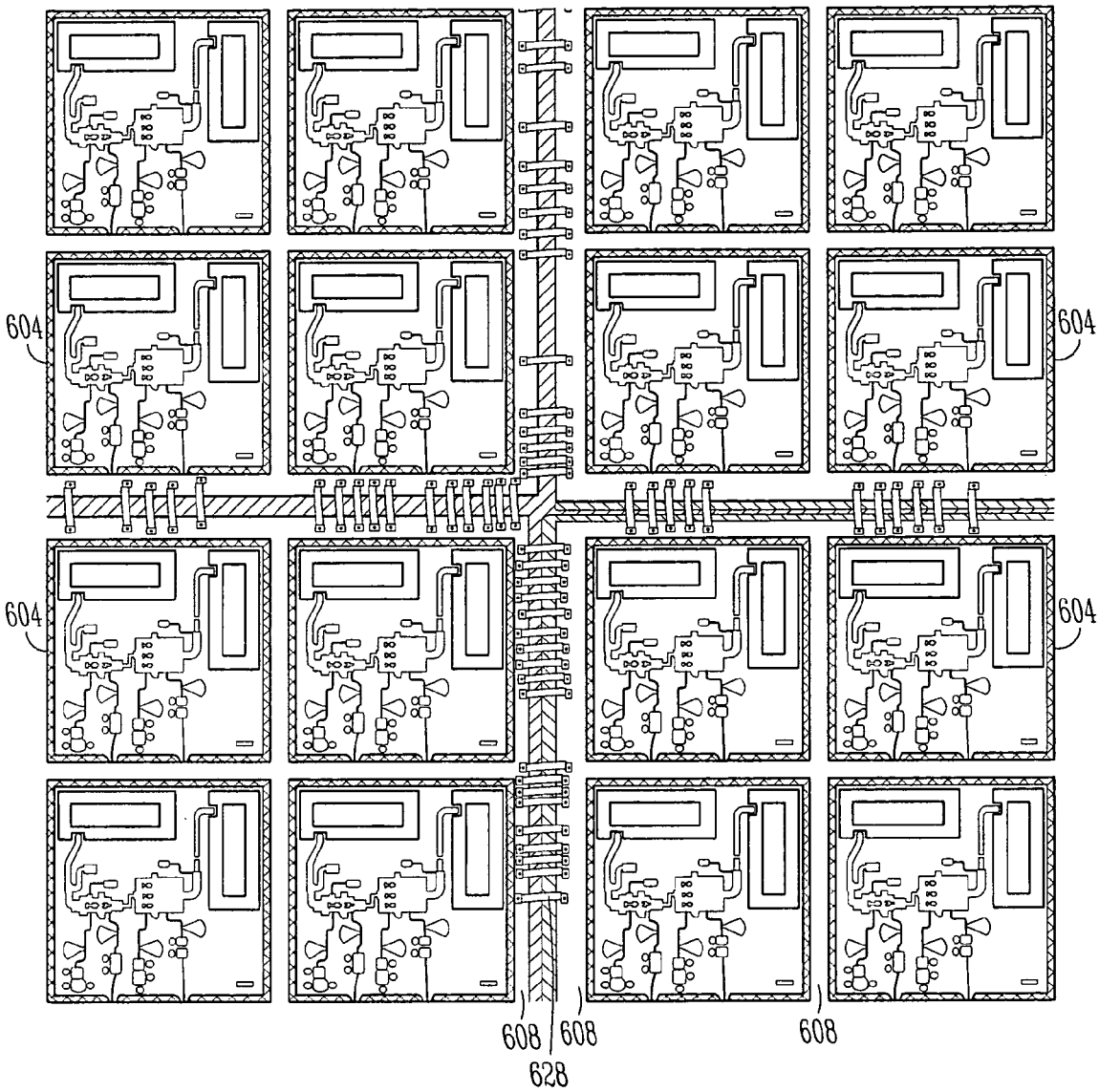
FIG. 6E illustrates a portion of the sub-array modules illustrated in FIG. 6C in accordance with some embodiments of the present invention.

FIGS. 6A and 6B illustrate a circuit board backing for reflect array antennas in accordance with some embodiments of the present invention. FIGS. 6C and 6D illustrate a group of sub-array modules on the circuit board of FIGS. 6A and 6B in accordance with some embodiments of the present invention. FIG. 6E illustrates a portion of the sub-array modules illustrated in FIG. 6C in accordance with some embodiments of the present invention.

In these alternate embodiments, the reflect array antenna includes an array of groups 606 (9 are shown) of monolithic sub-array modules 604 (e.g., chips). Each group 606 is adhered to or mounted on circuit board 620. In these embodiments, circuit board 620 includes DC bias current bonding pads 622 along at least one or more of its edges. In these embodiments, the outer sub-array modules 604 of a group receive DC bias current directly from the bonding pads 622.

In these embodiments, bond wires 626 may couple bonding pads 622 to bias grids 608 of monolithic sub-array modules 604 along the perimeter of the circuit board 620. Additional wire bonds 628 may be used to convey the DC bias current among one or more adjacent sub-array modules 604, such as the center module within each group 606. This is illustrated in FIG. 6E.

In some embodiments, each monolithic sub-array module 604 may comprises a number of sub-array elements 602. Sub-array element 300 (FIG. 3) may be suitable for use as one or more of sub-array elements 602. Monolithic sub-array modules 604 may also include bias grid 608 separating sub-array elements 602. Bias grid 608 may receive the DC bias current from bonding pads 622.

In some embodiments, the reflect array antenna may also include a heat sink. Groups 606 of the array may be arranged in a substantially uniform pattern without gaps in the pattern. Circuit boards 620 associated with each group 606 may be adhered to the heat sink.

In some of these alternate embodiments, monolithic sub-array modules 604 may be substantially square in shape, and circuit boards 620 that include groups 606 of monolithic sub-array modules 604 may also be substantially square in shape, although the scope of the invention is not limited in this respect. In some embodiments, each group 606 may have exactly a perfect square number of monolithic sub-array modules 604, and each monolithic sub-array module 604 may have exactly a perfect square number of sub-array elements 602. In these embodiments, the perfect square number of monolithic sub-array modules 604 of each group 606 may be either 4, 9, 16, 25, 36, 49, and the perfect square number of array elements 602 of each monolithic sub-array module 604 may be either 4, 9, 16, 25, 36, or 49 although greater perfect square numbers are also suitable.

In some embodiments, each sub-array element 602 may include a receive antenna to receive a spatially-fed radio-frequency RF input signal, an amplifier element to amplify the received RF input signal, and transmit antenna to transmit an amplified version of the RF input signal. An example of a suitable sub-array element is illustrated in FIG. 3.

In some embodiments, each sub-array module 604 may comprise a single monolithic substrate. In these embodiments, sub-array elements 602 of each sub-array module 604 may be fabricated on the single monolithic substrate. In some embodiments, the single monolithic substrate may include cavities adjacent to the receive and transmit antennas of the sub-array elements. In some embodiments, circuit board 620 includes cavities 630 aligned with the receive and transmit antennas of the sub-array elements. Cavities 630 may be portions on circuit board 620 without ground conductive material.

In some embodiments, the reflect array antenna may include a cooling assembly, such as array cooling assembly 400 (FIG. 4) coupled to the heat sink to cool the reflect array antenna. In some embodiments, the reflect array antenna may include a bias current layer, such as bias current layer 500 (FIG. 5) to provide the DC bias current to groups 606. In some embodiments, the reflect array antenna may include a temperature sensor, such as temperature sensor 520 (FIG. 5) to monitor a temperature of the reflect array antenna.

Figure 7B:
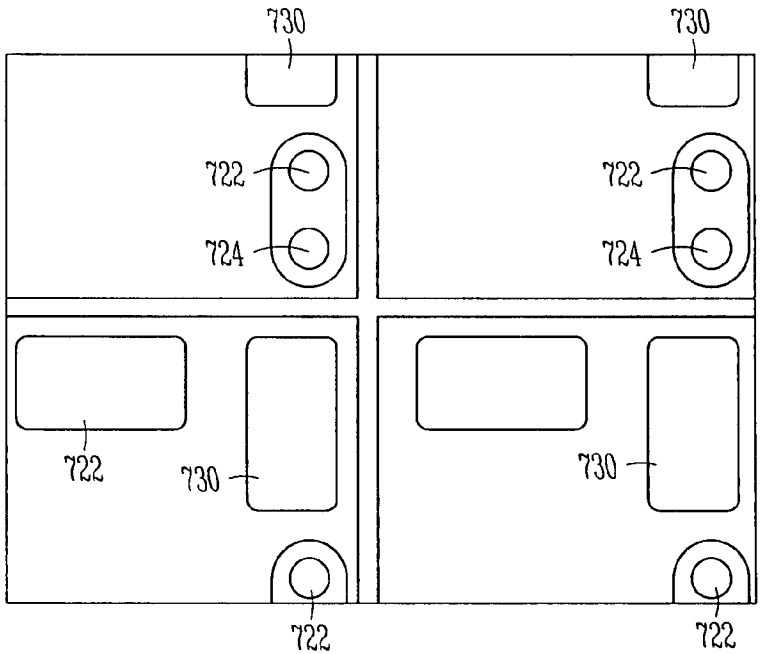
FIGS. 7A and 7B illustrate a circuit board backing for reflect array antennas in accordance with yet some other alternate embodiments of the present invention.
Figure 7A:
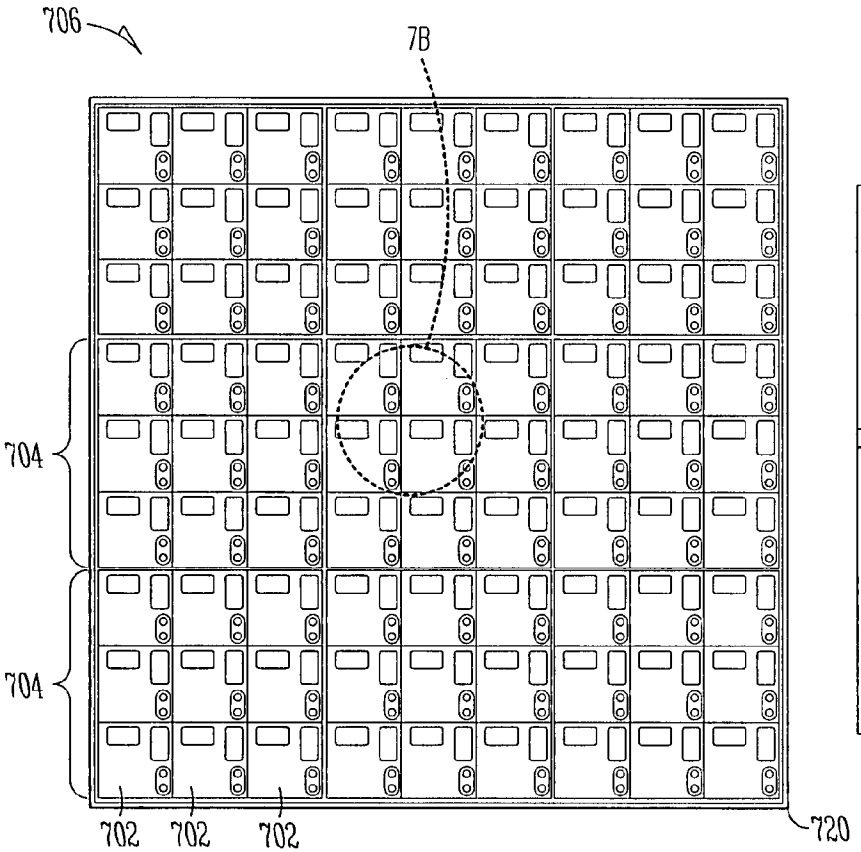
Figure 7C:
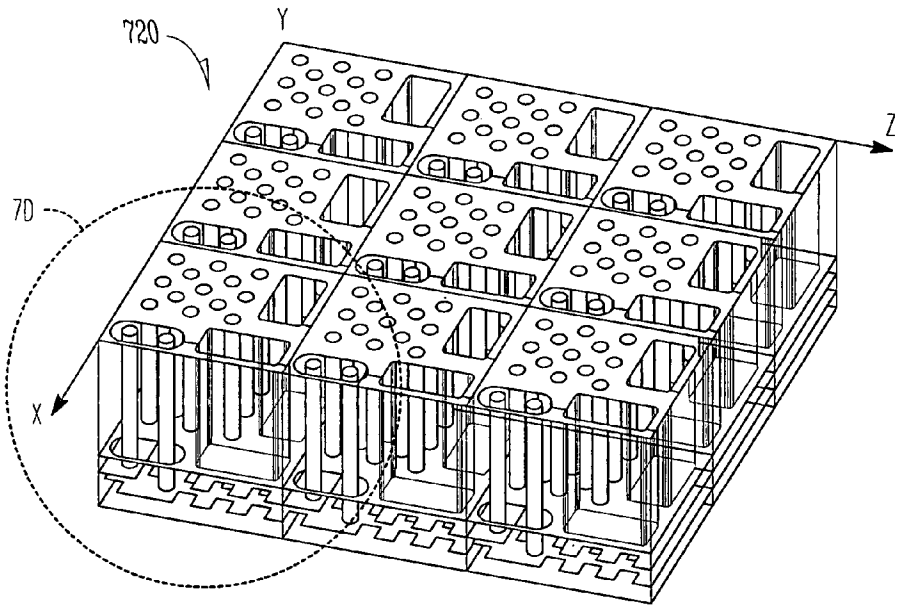
FIGS. 7C and 7D illustrate a portion of the circuit board of FIG. 7A in accordance with these other alternative embodiments of the present invention.
Figure 7D:
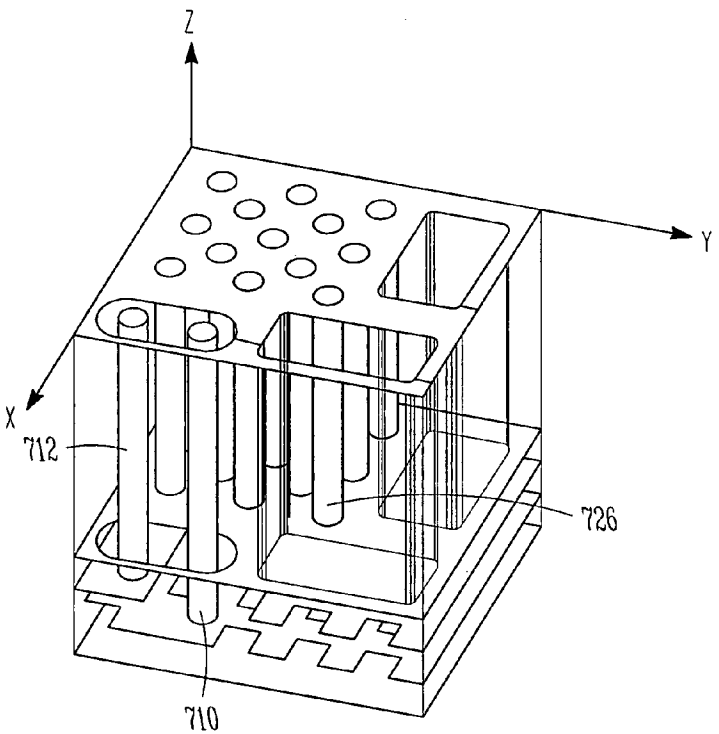

FIGS. 7A and 7B illustrate a circuit board backing for reflect array antennas in accordance with yet some other alternate embodiments of the present invention. FIGS. 7C and 7D illustrate a portion of the circuit board of FIG. 7A in accordance with these other alternative embodiments of the present invention. In these embodiments, DC power is routed through the back side of the chips (e.g., sub-array elements 702). In these embodiments, sub-array modules 704 are mounted on circuit boards 720, and the circuit boards 720 may be arranged and mounted on a heat sink. Thermal vias 726 may be used to cool the array.

The reflect array antenna of these alternate embodiments includes active sub-array elements 702 arranged in a uniform pattern on circuit board 720. Circuit board 720 includes a plurality of DC bias feeds 710 through circuit board 720 to couple with bias pads 722 of the sub-array elements 702. Circuit boards 720 may be arranged in a uniform pattern on a heat sink and circuit boards 720 may include thermal vias 726 to thermally couple sub-array elements 702 with the heat sink.

In some of these embodiments, active sub-array elements 702 may be fabricated on a single monolithic substrate to comprise sub-array module 704. The active array antenna of these embodiments may comprise a plurality of sub-array modules 704. A plurality of circuit boards 720 may be arranged in a uniform pattern. A group 706 of sub-array modules 704 may be adhered to each circuit board 720.

In some of these embodiments, the DC bias feeds include drain bias feed 710 and gate bias feed 712 for each active sub-array element 702. Drain bias feeds 710 and gate bias feed 712 may be provided through circuit board 720 to couple with bias-voltage planes of the circuit board. Each active sub-array element 702 may include drain bias pad 722 to couple with drain bias feed 710 of circuit board 720, and each active sub-array element 702 may include gate bias pad 724 to couple with gate bias feed 712 of circuit board 720.

In some of these embodiments, each sub-array element 702 may include a receive antenna, an amplifier element, and a transmit antenna. Sub-array element 102 (FIG. 3) may be suitable for use as one or more of sub-array elements 702, although the scope of the invention is not limited in this respect. In these embodiments, circuit board 720 may include cavities 730 aligned with receive and transmit antennas of active sub-array elements 702, although the scope of the invention is not limited in this respect. In some of these embodiments, the receive antenna, amplifier and transmit antenna may receive and re-transmit a spatially fed W-band RF input signal. In some embodiments, the receive and transmit antennas may have orthogonal polarizations, although the scope of the invention is not limited in this respect.

In some embodiments, the present invention provides a millimeter wave deterring device that includes an active reflect array antenna and a W-band RF source. The RF source may generate a substantially spherical wavefront for incident on the active reflect array antenna. The active reflect array antenna may amplify the incident wavefront and generate a high-power collimated or converging wavefront. The high-power wavefront may produce a deterring effect on a human target. In these embodiments, any of the active reflect array antenna previously discussed may be suitable. In some embodiments, the active reflect array antenna may include an array of rectangular monolithic sub-array modules arranged in a non-uniform pattern to leave a plurality of rectangular gaps in the pattern. A DC feed pin may be located within each gap to provide DC bias current to the sub-array modules.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus the following claims are hereby incorporated into the detailed description, with each claim standing on its own as a separate preferred embodiment.

What is claimed is:

1. A reflect array antenna comprising:

an array of rectangular monolithic sub-array modules arranged in a non-uniform pattern to leave a plurality of rectangular gaps in the pattern, the gaps being smaller in size than a size of the sub-array modules; and a DC feed pin located within each gap to provide DC bias current to the sub-array modules.

2. The reflect array antenna of claim 1 further comprising a heat sink, wherein the sub-array modules are mounted on the heat sink in the non-uniform pattern, and wherein the heat sink has holes aligned with the gaps to allow passage of the DC feed pins.

3. The reflect array antenna of claim 2 wherein the heat sink has a substantially paraboloidal surface, and wherein the sub-array modules are mounted on the substantially paraboloidal surface in the non-uniform pattern.

4. The reflect array antenna of claim 2 wherein each sub-array module comprises a number of sub-array elements, wherein the sub-array modules include a bias grid separating the sub-array elements, the DC bias grid to receive the DC bias current from the DC feed pins, and wherein the reflect array antenna further comprises a plurality DC feed lines coupling each of the DC feed pins to the bias grids of the sub-array elements adjacent to the gaps.

5. The reflect array antenna of claim 4 wherein the sub-array elements include an amplifier element that receives some of the DC bias current that is supplied at a bias voltage between two and three volts.

6. The reflect array antenna of claim 4 further comprising wire bonds coupling the bias grids of adjacent sub-array modules.

7. The reflect array antenna of claim 4 wherein the DC feed pin within each gap is a first DC feed pin to provide drain current to amplifier elements of the sub-array modules, and wherein the reflect array antenna further comprises a second feed pin within each gap, the second feed pin to provide gate current to amplifier elements of the sub-array modules.

8. The reflect array antenna of claim 4 wherein each sub-array element comprises:

a receive antenna to receive a spatially-fed radio-frequency (RF) input signal;

an amplifier element to amplify the received RF input signal; and a transmit antenna to transmit an amplified version of the RF input signal.

9. The reflect array antenna of claim 8 wherein the RF input signal is a W-band signal, and wherein the receive antenna and transmit antennas have orthogonal polarizations.

10. The reflect array antenna of claim 8 wherein each sub-array module comprises a single monolithic substrate, wherein the sub-array elements of each sub-array module are fabricated on the single monolithic substrate, wherein the receive antennas and the transmit antennas are cavity-backed antennas, and wherein the single integrated substrate includes cavities adjacent to the receive and transmit antennas.

11. The reflect array antenna of claim 2 further comprising an array cooling assembly coupled to the heat sink to cool the reflect array antenna, wherein the array cooling assembly has holes aligned with the gaps to allow passage of the DC feed pins, and wherein the array cooling assembly is cooled by a coolant that flows through the array cooling assembly.

12. The reflect array of claim 11 wherein the coolant is a phase-change fluid.

13. The reflect array antenna of claim 11 further comprising a bias current layer to provide the DC bias current to the sub-array modules, wherein the array cooling assembly is located between the heat sink and the bias current layer.

14. The reflect array antenna of claim 13 further comprising a temperature sensor to monitor a temperature of the reflect array antenna, wherein at least one of pressure and flow-rate of the coolant is controlled based on the monitored temperature.

15. The reflect array antenna of claim 1 wherein the sub-array modules are substantially square and wherein the gaps are substantially square, wherein the sub-array modules has exactly a perfect square number of active array elements, and wherein an area of each of the gaps in the pattern is substantially a square area equal to approximately a perfect square number of active array elements that is lower than the perfect square number of active array elements of each sub-array module.

16. The reflect array antenna of claim 15 wherein the perfect square number of active array elements of each sub-array module comprises one of either 4, 9, 16, 25, 36, 49.

17. The reflect array antenna of claim 16 wherein each sub-array module comprises nine active array elements, and wherein the area of the gap is approximately equal to an area of either one or four of the active array elements.

18. The reflect array of claim 17 wherein the pattern includes one gap for approximately every twelve sub-array modules.

19. The reflect array of claim 17 wherein the pattern includes one gap for approximately every twenty-four sub-array modules.

20. A reflect array antenna comprising:

an array of groups of monolithic sub-array modules, each group adhered to a circuit board, wherein each circuit board includes DC bias current bonding pads along at least one of its edges, and wherein the outer sub-array modules of a group receive DC bias current directly from the bonding pads.

21. The reflect array antenna of claim 20 wherein bond wires couple the bonding pads to bias grids of the monolithic sub-array modules along a perimeter of the circuit board.

22. The reflect array antenna of claim 21 wherein additional wire bonds convey the DC bias current among one or more adjacent sub-array modules within each group.

23. The reflect array of claim 21 wherein each monolithic sub-array module comprises a number of sub-array elements, and wherein the monolithic sub-array modules include the bias grid separating the sub-array elements, wherein the bias grid receives the DC bias current from the bonding pads.

24. The reflect array antenna of claim 23 wherein each sub-array element comprises:

a receive antenna to receive a spatially-fed radio-frequency (RF) input signal;

an amplifier element to amplify the received RF input signal; and a transmit antenna to transmit an amplified version of the RF input signal.

25. The reflect array antenna of claim 24 wherein the RF input signal is a W-band signal, wherein the receive antenna and transmit antennas have orthogonal polarizations.

26. The reflect array antenna of claim 24 wherein each sub-array module comprises a single monolithic substrate, wherein the sub-array elements of each sub-array module are also fabricated on the single monolithic substrate, wherein the receive antennas and the transmit antennas are cavity-backed antennas, and wherein the single integrated substrate includes cavities adjacent to the receive and transmit antennas.

27. The reflect array antenna of claim 26 wherein the circuit board further includes cavities aligned with the receive and transmit antennas of the sub-array elements, the cavities of the circuit board being portions on the circuit board without ground conductive material.

28. The reflect array of claim 21 further comprising a heat sink, wherein the groups of the array are arranged in a substantially uniform pattern without gaps in the pattern, and wherein the circuit board associated with each group is adhered to the heat sink.

29. The reflect array antenna of claim 28 further comprising an array cooling assembly coupled to the heat sink to cool the reflect array antenna, wherein the array cooling assembly is cooled by a coolant that flows through the array cooling assembly.

30. The reflect array antenna of claim 29 further comprising a bias current layer to provide the DC bias current to the groups, wherein the array cooling assembly is located between the heat sink and the bias current layer.

31. The reflect array antenna of claim 30 further comprising a temperature sensor to monitor a temperature of the reflect array antenna, wherein at least one of pressure and flow-rate of the coolant is controlled based on the monitored temperature.

32. The reflect array antenna of claim 21 wherein the monolithic sub-array modules are substantially square in shape, and wherein the circuit boards that include the groups of monolithic sub-array modules are substantially square in shape.

33. The reflect array antenna of claim 21 wherein each group has exactly a perfect square number of monolithic sub-array modules, and wherein each monolithic sub-array module has exactly a perfect square number of sub-array elements.

34. The reflect array antenna of claim 33 wherein the perfect square number of monolithic sub-array modules of each group comprises one of either 4, 9, 16, 25, 36, 49, and wherein the perfect square number of array elements of each monolithic sub-array module comprises one of 4, 9, 16, 25, 36, 49.

35. A reflect array antenna comprising;

a plurality of active sub-array elements arranged in a uniform pattern on a circuit board, wherein the circuit board includes a plurality of DC bias feeds through the circuit board to couple with bias pads of the sub-array elements, wherein a plurality of the active sub-array elements are fabricated on a single monolithic substrate to comprise a sub-array module, wherein the active array antenna comprises a plurality of the sub-array modules, wherein the reflect array antenna comprises a plurality of the circuit boards are arranged in a uniform pattern, wherein a group of the sub-array modules are adhered to each circuit board, wherein the plurality of circuit boards are arranged in a uniform pattern on a heat sink, and wherein the circuit boards further comprise thermal vias to thermally couple the sub-array elements with the heat sink.

36. The reflect array antenna of claim 35 wherein the DC bias feeds include a drain bias feed and a gate bias feed for each active sub-array element, the drain bias feeds and gate bias feed being provided through the circuit board, wherein each active sub-array element includes a drain bias pad to couple with the drain bias feed of the circuit board, and wherein each active sub-array element includes a gate bias pad to couple with the gate bias feed of the circuit board.

37. A reflect array antenna comprising;

a plurality of active sub-array elements arranged in a uniform pattern on a circuit board, wherein the circuit board includes a plurality of DC bias feeds through the circuit board to couple with bias pads of the sub-array elements, wherein each sub-array element comprises a receive antenna, an amplifier element, and a transmit antenna, and wherein the circuit board includes cavities aligned with receive and transmit antennas of the active sub-array elements.

38. The reflect array antenna of claim 37 wherein the receive antenna, amplifier and transmit antenna receive and re-transmit a spatially fed W-band RF input signal, and wherein the receive antenna and transmit antennas have orthogonal polarizations.

39. A millimeter wave deterring device comprising:

an active reflect array antenna; and a W-band RF source to generate a substantially spherical wavefront for incident on the active reflect array antenna, the active reflect array antenna to amplify the incident wavefront and generate a high-power wavefront, the high-power wavefront is to produce a deterring effect on a target, wherein the active reflect array antenna comprises:

an array of rectangular monolithic sub-array modules arranged in a non-uniform pattern to leave a plurality of rectangular gaps in the pattern, the gaps being smaller in size than a size of the sub-array modules; and a DC feed pin located within each gap to provide DC bias current to the sub-array modules.

40. The weapon of claim 39 further comprising a heat sink, wherein the sub-array modules are mounted on the heat sink in the non-uniform pattern, and wherein the heat sink has holes aligned with the gaps to allow passage of the DC feed pins.

41. The weapon of claim 40 wherein the heat sink has a substantially paraboloidal surface, and wherein the sub-array modules are mounted on the substantially paraboloidal surface in the non-uniform pattern to generate either a collimated or converging wavefront.

42. The weapon of claim 40 wherein each sub-array module comprises a number of sub-array elements, wherein the sub-array modules include a bias grid separating the sub-array elements, the DC bias grid to receive the DC bias current from the DC feed pins, and wherein the reflect array antenna further comprises a plurality DC feed lines coupling each of the DC feed pins to the bias grids of the sub-array elements adjacent to the gaps.

43. The weapon of claim 42 wherein each sub-array element comprises:

a receive antenna to receive a spatially-fed radio-frequency (RF) input signal;

an amplifier element to amplify the received RF input signal; and a transmit antenna to transmit an amplified version of the RF input signal.

44. The weapon of claim 43 wherein the RF input signal is a W-band signal.

45. The weapon of claim 43 w wherein the receive antenna and transmit antennas have orthogonal polarizations.

46. The weapon of claim 43 wherein each sub-array module comprises a single monolithic substrate, and wherein the sub-array elements of each sub-array module are fabricated on the single monolithic substrate.

47. The weapon of claim 43 wherein the RF input signal is a W-band signal.

48. The weapon of claim 43 wherein the receive antennas and the transmit antennas are cavity-backed antennas, and wherein the single integrated substrate includes cavities adjacent to the receive and transmit antennas.

49. The weapon of claim 40 further comprising an array cooling assembly coupled to the heat sink to cool the reflect array antenna, wherein the array cooling assembly has holes aligned with the gaps to allow passage of the DC feed pins, and wherein the array cooling assembly is cooled by a coolant that flows though the array cooling assembly.

* * * * *

UNITED STATES PATENT AND TRADEMARK OFFICE

CERTIFICATE OF CORRECTION

PATENT NO. : 7,423,601 B2
APPLICATION NO. : 11/254460
DATED : September 9, 2008
INVENTOR(S) : Brown et al.

It is certified that error appears in the above-identified patent and that said Letters Patent is hereby corrected as shown below:

On the title page, item (75), in "Inventors", in column 1, line 2, after "George" delete "G." and insert -- K. --, therefor.

In column 12, line 26, in Claim 45, after "43" delete "w".

In column 12, line 44, in Claim 49, delete "though" and insert -- through --, therefor.

Signed and Sealed this

Twenty-fifth Day of November, 2008

JON W. DUDAS
*Director of the United States Patent and Trademark Office*